US008316755B2

(12) United States Patent
Overstreet et al.

(10) Patent No.: US 8,316,755 B2
(45) Date of Patent: Nov. 27, 2012

(54) COTTER PIN ANTI ROTATION MECHANISM FOR ACCOMMODATING SUB CALIBER AMMUNITION UTILIZED IN AN AR-15 TYPE FIREARM

(75) Inventors: John L. Overstreet, Fayette, MO (US); Jordan Bowles, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 61 days.

(21) Appl. No.: 13/078,073

(22) Filed: Apr. 1, 2011

(65) Prior Publication Data

US 2011/0252685 A1 Oct. 20, 2011

Related U.S. Application Data

(60) Provisional application No. 61/324,469, filed on Apr. 15, 2010.

(51) Int. Cl.
*F41A 5/24* (2006.01)

(52) U.S. Cl. ..... 89/179; 89/132; 89/185; 42/16; 42/69.01

(58) Field of Classification Search ..... 42/16, 69.01, 42/69.02; 89/179, 132, 185
See application file for complete search history.

(56) References Cited

U.S. PATENT DOCUMENTS

| | | | | | |
|---|---|---|---|---|---|
| 1,451,443 | A * | 4/1923 | Fowler | 89/149 |
| 2,465,402 | A * | 3/1949 | Skinner et al. | 89/1.813 |
| 2,468,784 | A * | 5/1949 | Seagraves | 89/185 |
| 2,977,852 | A * | 4/1961 | Reuwer et al. | 89/1.1 |
| 3,020,845 | A * | 2/1962 | Hardesty | 102/222 |
| 3,757,447 | A * | 9/1973 | Rowe | 42/51 |
| 3,776,095 | A | 12/1973 | Atchisson | |
| 3,938,271 | A * | 2/1976 | Hyytinen | 42/16 |
| 4,008,537 | A | 2/1977 | Elbe | |
| 4,246,830 | A | 1/1981 | Krieger | |
| 4,757,629 | A | 7/1988 | Austin | |
| 5,303,906 | A * | 4/1994 | Cotter et al. | 267/64.11 |
| 5,421,119 | A | 6/1995 | Miner | |
| 5,537,769 | A | 7/1996 | Hargraves et al. | |
| 5,941,005 | A | 8/1999 | Battaglia et al. | |
| 6,061,944 | A | 5/2000 | Schroeder | |
| 7,107,715 | B2 | 9/2006 | Keeney et al. | |
| 7,347,021 | B1 | 3/2008 | Jones | |
| 7,827,722 | B1 | 11/2010 | Davies | |
| 7,874,240 | B2 * | 1/2011 | Akhavan | 89/179 |
| 7,895,786 | B2 | 3/2011 | Caulley | |
| 7,930,968 | B2 | 4/2011 | Giefing | |
| 7,937,870 | B2 | 5/2011 | Brown | |
| 8,210,089 | B2 * | 7/2012 | Brown | 89/191.02 |
| 2009/0100733 | A1 * | 4/2009 | Zumalde | 42/23 |
| 2011/0277368 | A1 * | 11/2011 | Overstreet et al. | 42/108 |
| 2012/0042554 | A1 * | 2/2012 | Rich | 42/16 |

* cited by examiner

*Primary Examiner* — Michael David
(74) *Attorney, Agent, or Firm* — Gifford, Krass, Sprinkle, Anderson & Citkowski, P.C.

(57) ABSTRACT

An anti-rotation feature incorporated between a cotter pin and a sub caliber action device installable within an upper receiver of a firearm. A receiver plate exhibits a notched interior for seating a bolt in reciprocating fashion. A chamfer formed in a side of the bolt intersects a length extending channel of the bolt for seating within the notched interior. The chamfer seating a head of the cotter pin to prevent rotation during bolt travel. A rearward support sleeve seats an opposing guide rod associated with the receiver plate and in order to maintain the bolt assembly. A firing pin exhibits a notch at a location along its shaft and, upon installation within an interior aperture of the bolt, is retained in position by the cotter pin. The firing pin is configured so as to exhibit a reduced diameter end projection upon which is supported a coil spring.

7 Claims, 2 Drawing Sheets

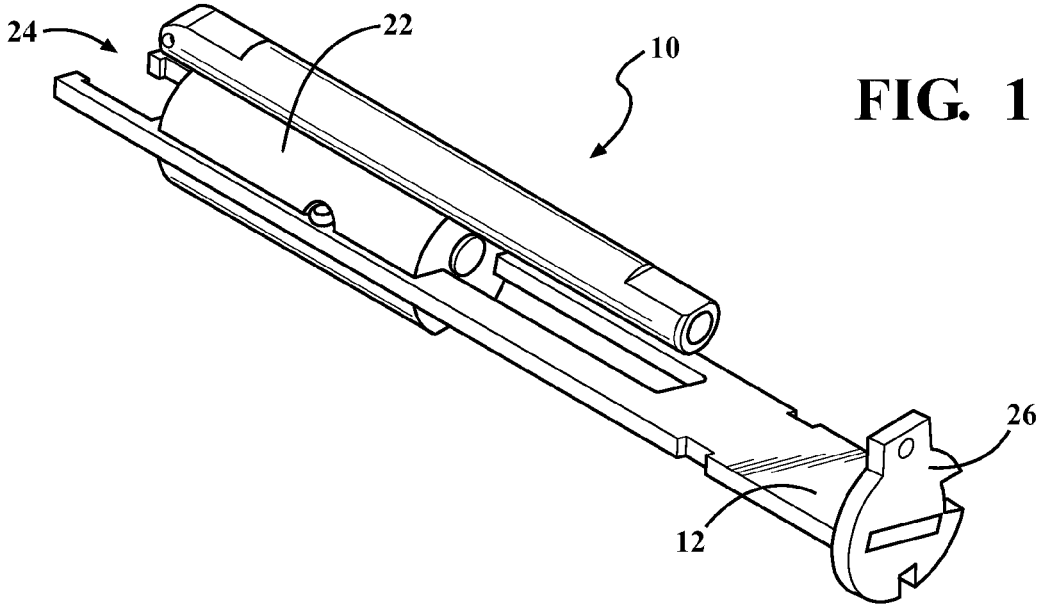
FIG. 1
FIG. 3
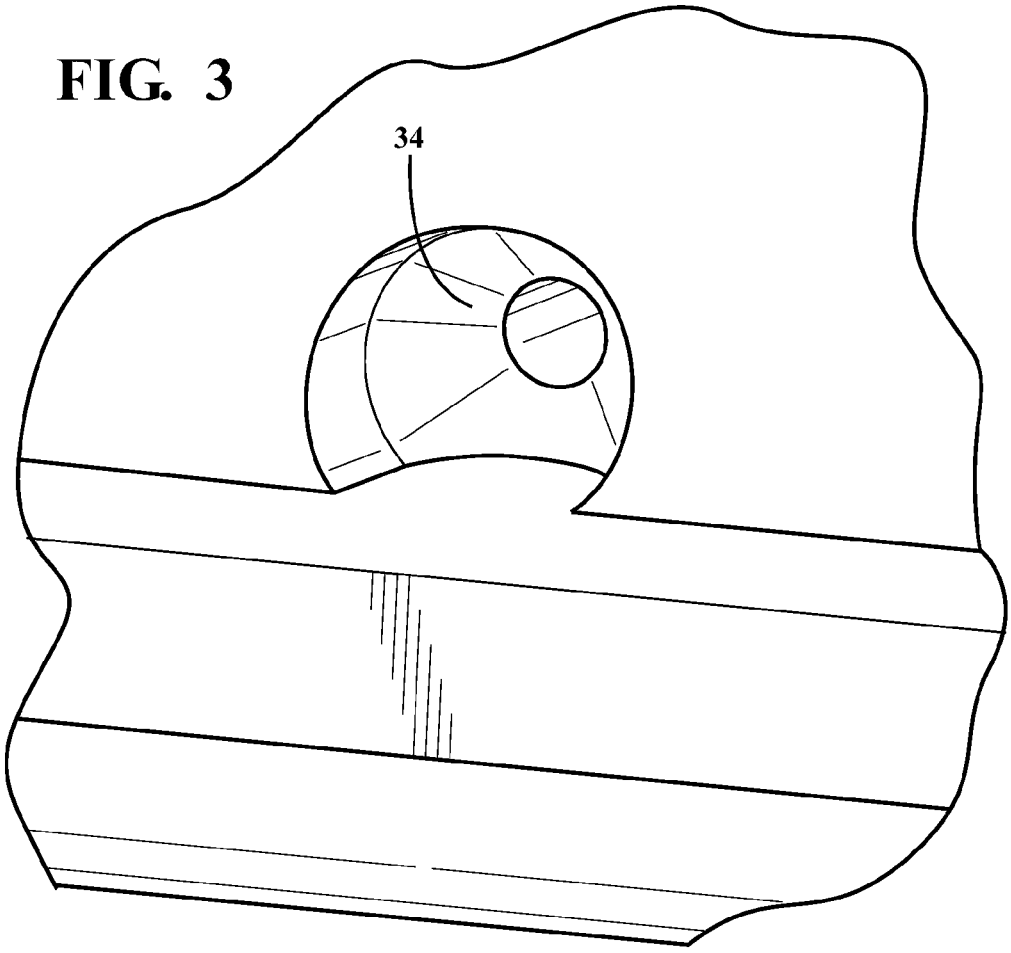

COTTER PIN ANTI ROTATION MECHANISM FOR ACCOMMODATING SUB CALIBER AMMUNITION UTILIZED IN AN AR-15 TYPE FIREARM

CROSS REFERENCE TO RELATED APPLICATIONS

The present application claims priority of U.S. Ser. No. 61/324,469 filed Apr. 15, 2010.

FIELD OF THE INVENTION

The present invention discloses an anti rotation mechanism using a standard AR15/M16 cotter pin and which includes a chamfered hole formed in an associated rim fire bolt into which is installed a firing pin exhibiting a notch feature so as to be retained in position by the pin. The chamfer hole is positioned in proximity to a pair of side recess channels extending along a rim fire bolt, the bolt in turn seated within a notched lengthwise extending interior of an associated receiver plate. The sub caliber action device is installed within the barrel of an upper receiver installable sub caliber action device and reduces cotter pin wear by preventing rotation during reciprocating bolt travel, this resulting from the configuration of the side configured chamfer intersecting the receiver mounting plate recess defined in the bolt which acts to establish an anti-rotating seat for the enlarged cotter pin head.

DESCRIPTION OF THE PRIOR ART

The use of a cotter pin in such as an M16 or AR-15 type firearm is know in the art and is utilized for holding in place the firing pin associated with the reciprocating bolt. A problem associated with existing cotter pins is their tendency to rotate during bolt travel with resulting wear on the firing pin.

SUMMARY OF THE PRESENT INVENTION

The present invention discloses an anti-rotation feature incorporated into an interface established between a cotter pin and a sub caliber action device installable within an upper receiver of an AR-15 type firearm. A generally elongated receiver plate exhibits a generally lengthwise extending notched interior established between extending sides. The notched interior seats a bolt in reciprocating fashion along said receiver plate. A chamfer feature is formed in a side of the bolt in intersecting fashion with a selected length extending channel of the bolt for seating within the notched interior, the chamfer feature seating a head of the cotter pin to prevent rotation during bolt travel.

Additional features include a rearward projecting support sleeve including an open interior for receiving and seating an opposing guide rod associated with a further mounting location of the receiver plate and in order to maintain in assembled fashion the forward assist adaptor. A firing pin exhibits a notch feature configured at a location along its shaft and which, upon installation within an interior aperture of the bolt, is retained in position by the cotter pin. The firing pin is configured so as to exhibit a reduced diameter end projection upon which is supported a coil spring.

DESCRIPTION OF THE DRAWINGS

Reference will now be made to the attached drawings, when read in combination with the following detailed description, wherein like reference numerals refer to like parts throughout the several views, and in which:

FIG. 1 is an assembled perspective of the sub caliber action device with built-in anti-rotation mechanism according to the invention;

FIG. 3 is an enlarged partial perspective of the modified bolt with chamfer shaped hole formed therein for receiving the anti-rotation cotter pin for engaging and preventing rotation of the installed firing pin.

DETAILED DESCRIPTION OF THE PREFERRED EMBODIMENTS

Figure 2:
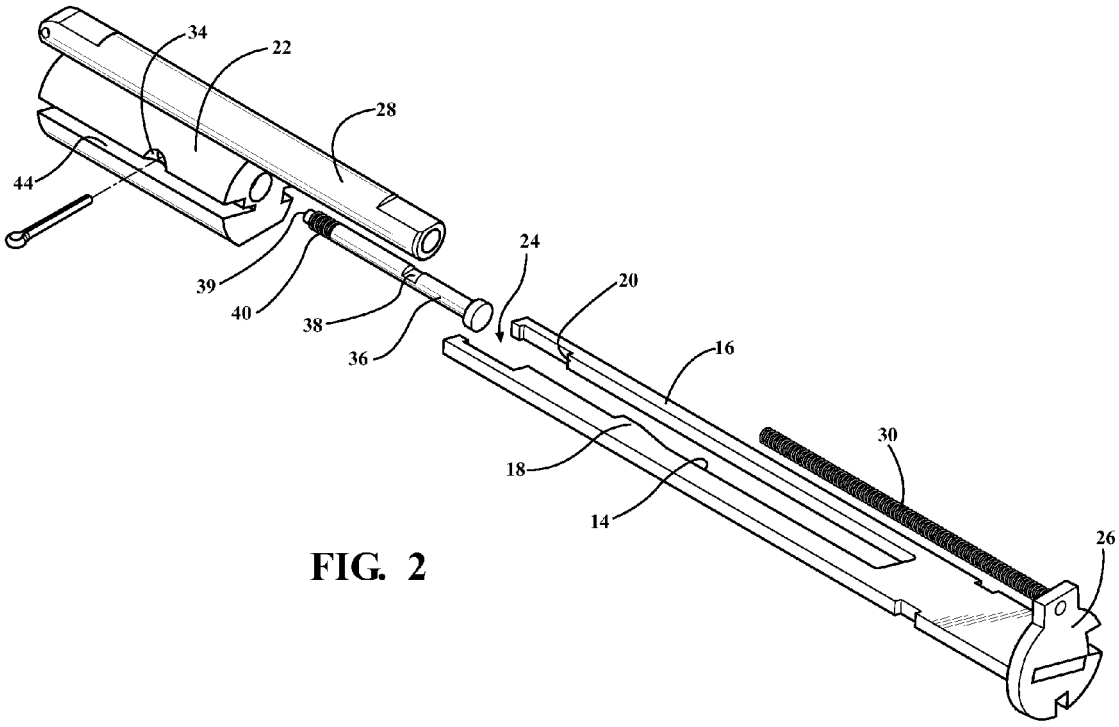
FIG. 2 is an exploded view of the sub caliber action device in FIG. 1.

Referring now to the following illustrations, the present invention discloses an upper receiver installable sub-caliber action, again for both drop-in and dedicated variants and including a modified bolt assembly with side configured chamfer feature in proximity to a side disposed bolt recess for seating upon the associated receiver plate in use with such as an AR-15 type firearm and which prevents rotation of the cotter pin. As previously described, the present invention prevents rotation of the cotter pin during bolt travel along the receiver plate by virtue of the anti-rotation feature established by the intersection of the chamfer and side disposed seating recess of the bolt.

Referring to each of FIGS. 1 and 2, both assembled and exploded perspectives are shown of a forward assist sub caliber action device and which includes an adaptor bolt subassembly generally shown at 10 in FIG. 1. A generally elongated receiver plate is shown at 12 and exhibits a generally lengthwise extending notched or keyed interior, established between generally parallel extending sides 14 and 16, reference further being made to opposing and inwardly facing protrusions 18 and 20 established along the open notch for seating a bolt 22 (such as but not limited to a rim fire style bolt). The end plate notch further extends a distance from an open end 24 to an intermediate location short of an opposite end support 26.

The notched interior is configured for seating the bolt 22, such further including a side disposed extractor and interfacing with a forward-most projecting chamber adaptor (not shown). The configuration of the bolt 22 is further such that a rearward projecting support sleeve 28 includes an open interior for receiving and seating an opposing guide rod with exteriorly supported coil spring 30 associated with a further mounting location of the receiver plate 12 and in order to maintain in assembled fashion the adaptor bolt subassembly 10 (such as is known as a .22 caliber adaptor bolt).

An anti rotation mechanism is incorporated using a standard AR15/M16 cotter pin 32 and which includes a chamfered hole (see configured surface 34 in each of FIGS. 2 and 3) which is formed in the rim fire bolt 22 into which is installed a firing pin 36 exhibiting a notch feature 38 configured at a location along its shaft which, upon installation within the bolt, is retained in position by the pin 32. A reduced diameter end projection 39 of the firing pin 36 supports a coil spring 40 such that, upon inserting lengthwise within the central configured aperture 42 defined in the rim fire bolt 22, the firing pin is supported in a generally cushioned and positionally biased fashion.

The chamfer hole configuration 34 is positioned in proximity to a selected channel 44 of a pair of side recess channels extending along the rim fire bolt 22, the bolt in turn seating within the notched lengthwise extending interior of the associated receiver plate 12 in the manner shown in FIG. 1. The sub caliber action device is installed within the barrel of an upper receiver installable sub caliber action device and reduces cotter pin wear by preventing rotation during reciprocating bolt travel, this resulting from the configuration of the side configured chamfer 34 intersecting the receiver seating recess channel 44 defined in the bolt, this creating a flattened profile area for seating the enlarged head of the cotter pin and acting to establish anti-rotation of the pin during reciprocating bolt travel.

The present invention further contemplates the provision of an extractor pin and which, in contrast to use with such as a factory design bolt in which the pin can be engaged through in either direction, the redesigned version contemplated by the invention will install from the bottom of the bolt and project from the same direction. This is accomplished by making the top of the hole smaller and is rendered necessary so that the pin will not displace through the top of the bolt and thereby become lodged in the firing mechanism.

As is known, the bolt assembly is a mechanical part of the firearm upper receiver and which is seated within a barrel at a location in which it blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards) via a forward extending gas port and an upper and rear extending/rerouting of a gas tube for utilizing the gas blowback to successively eject and reload (re-chamber) a succeeding round.

Upon moving back, an extractor associated with the bolt pulls a spent cartridge casing (not shown) from an attached magazine (not shown) and pushes it into a firearm chamber established between the upper and lower assembled receivers (not shown). Upon successive discharge, and once the spent shell casing case is clear of the chamber, an ejector component of the bolt ejects the casing from the receiver and out of the firearm (such as through a side window of the upper receiver which exposes the firing chamber.

The sub caliber action device is further seated within a rear open end of the upper receiver portion of an AR-15 firearm. Without further elaboration, additional existing and interfacing features associated with the upper receiver include an underside accessible aperture defined in a lengthwise configured barrel portion for receiving an associated lower receiver and communicating magazine, and within which is installed the reciprocating bolt subassembly.

Additional existing features of the upper receiver (also not shown) include the provision of a forward assist subassembly mounted in angularly extending and integrated fashion into a rear housing location of the upper receiver and which seats a forward assist plunger. Also included is a charging handle for assisting in seating, supporting and removing of the adaptor bolt assembly within the upper receiver.

Having described my invention, other and additional preferred embodiments will become apparent to those skilled in the art to which it pertains, and without deviating from the scope of the appended claims.

We claim:

1. An anti-rotation feature incorporated into an interface established between a cotter pin and a sub caliber action device installable within an upper receiver of an AR-15 type firearm, said device comprising:

a generally elongated receiver plate exhibiting a generally lengthwise extending notched interior established between extending sides;

said notched interior seating a bolt in reciprocating fashion along said receiver plate; and a chamfer feature formed in a side of said bolt in intersecting fashion with a selected length extending channels for seating within said notched interior, said chamfer feature seating a head of the cotter pin upon insertion within said bolt so as to prevent rotation during bolt travel.

2. The invention as described in claim 1, said bolt further comprising a rearward projecting support sleeve including an open interior for receiving and seating an opposing guide rod associated with a further mounting location of said receiver plate and in order to maintain said bolt in assembled fashion.

3. The invention as described in claim 1, further comprising a firing pin exhibiting a notch feature configured at a location along its shaft and which, upon installation within a lengthwise extending interior aperture of said bolt, is retained in position by said cotter pin.

4. The invention as described in claim 1, further comprising a reduced diameter end projection formed upon an inserting end of said firing pin upon which is supported a coil spring.

5. An anti-rotation feature incorporated into an interface established between a cotter pin and a sub caliber action device installable within an upper receiver of an AR-15 type firearm, said device comprising:

a generally elongated receiver plate exhibiting a generally lengthwise extending notched interior established between extending sides;

said notched interior seating length extending side channels defined in a bolt and for mounting said bolt in reciprocating fashion along said receiver plate; and a firing pin exhibiting a notch feature configured at a location along its shaft and which, upon installation within a lengthwise interior aperture of said bolt, is retained in position by said cotter pin via a chamfer recess feature formed in a side of said bolt for receiving the cotter pin in communicating fashion with said firing pin, said chamfer feature seating a head of the cotter pin so as to prevent rotation thereof during bolt travel.

6. The invention as described in claim 5, said bolt further comprising a rearward projecting support sleeve including an open interior for receiving and seating an opposing guide rod associated with a further mounting location of said receiver plate and in order to maintain said bolt in assembled fashion.

7. The invention as described in claim 5, further comprising a reduced diameter end projection formed upon an inserting end of said firing pin upon which is supported a coil spring.

* * * * *